US007564742B2

(12) United States Patent
Muraji

(10) Patent No.: US 7,564,742 B2
(45) Date of Patent: Jul. 21, 2009

(54) TIMEPIECE HAVING OPENABLE AND CLOSEABLE DIAL PLATE

(75) Inventor: Toyonori Muraji, Tokyo (JP)

(73) Assignee: Seiko Clock Inc., Tokyo (JP)

( * ) Notice: Subject to any disclaimer, the term of this patent is extended or adjusted under 35 U.S.C. 154(b) by 0 days.

(21) Appl. No.: 12/078,161

(22) Filed: Mar. 27, 2008

(65) Prior Publication Data

US 2008/0239884 A1 Oct. 2, 2008

(30) Foreign Application Priority Data

Mar. 30, 2007 (JP) ..... 2007-094300

(51) Int. Cl.
*G04B 19/04* (2006.01)

(52) U.S. Cl. ..... 368/228; 368/232; 368/285

(58) Field of Classification Search ..... 368/75, 368/223, 228, 232, 285
See application file for complete search history.

(56) References Cited

U.S. PATENT DOCUMENTS 5,161,130 A * 11/1992 Sato et al. ..... 368/228
6,229,768 B1 * 5/2001 Nakazawa et al. ..... 368/223

FOREIGN PATENT DOCUMENTS

| | | | |
|---|---|---|---|
| JP | A-62-053388 | | 4/1987 |
| JP | A-03-019987 | | 2/1991 |
| JP | 06222161 | A * | 8/1994 |
| JP | A-2001-153971 | | 6/2001 |
| WO | WO 2006077240 | A2 * | 7/2006 |

* cited by examiner

*Primary Examiner*—Vit W Miska
*Assistant Examiner*—Jason Collins
(74) *Attorney, Agent, or Firm*—Oliff & Berridge, PLC

(57) ABSTRACT

A timepiece having an openable and closable dial plate, includes a stationary segment included in the dial plate, and a movable segment included in the dial plate and reciprocating between an open position and a closed position, the movable segment being positioned at the closed position by abutting with the stationary segment.

6 Claims, 8 Drawing Sheets

TIMEPIECE HAVING OPENABLE AND CLOSEABLE DIAL PLATE

BACKGROUND OF THE INVENTION

1. Field of the Invention

The present invention relates to a timepiece, and more particularly, to a timepiece having an openable and closable dial plate.

2. Description of the Related Art

Conventionally, there have been known timepieces having a dial plate composed of a plurality of movable segments, which move to expose an ornamental member located behind the movable segments, for example, on the hour.

A timepiece has a dial plate composed of divided parts, which are moved to open an ornamental member. This kind of timepiece is required to have good visibility to the dial plate.

SUMMARY OF THE INVENTION

It is, therefore, an object of the present invention to provide a timepiece having improved visibility to a dial plate.

According to an aspect of the present invention, there is provided a timepiece having an openable and closable dial plate, a stationary segment included in the dial plate, and a movable segment included in the dial plate and reciprocating between an open position and a closed position, the movable segment being positioned at the closed position by abutting with the stationary segment.

DETAILED DESCRIPTION OF THE PREFERRED EMBODIMENTS

An exemplary timepiece according to an embodiment of the present invention will be described below with reference to the accompanying drawings.

Figure 1:
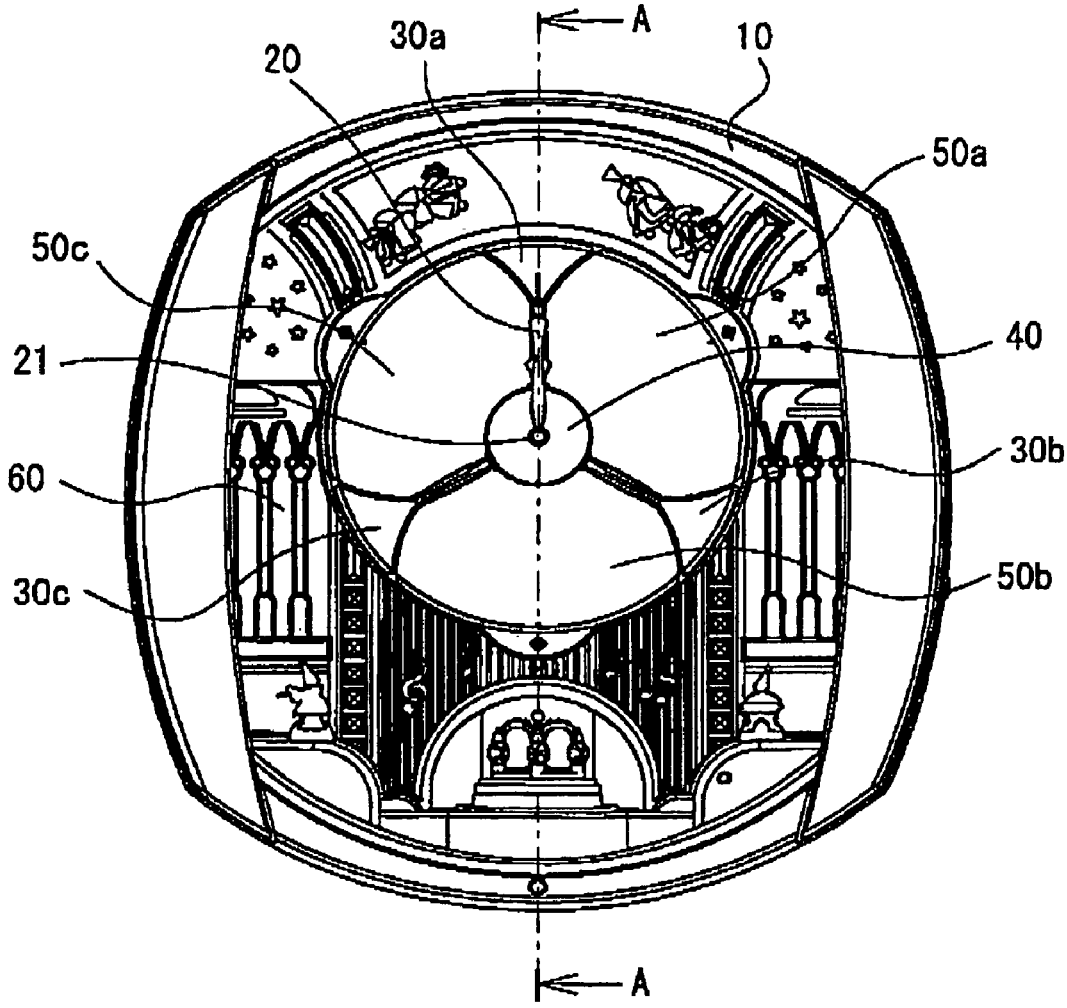
FIG. 1 is a front view of a timepiece according to an embodiment of the present invention.
Figure 2:
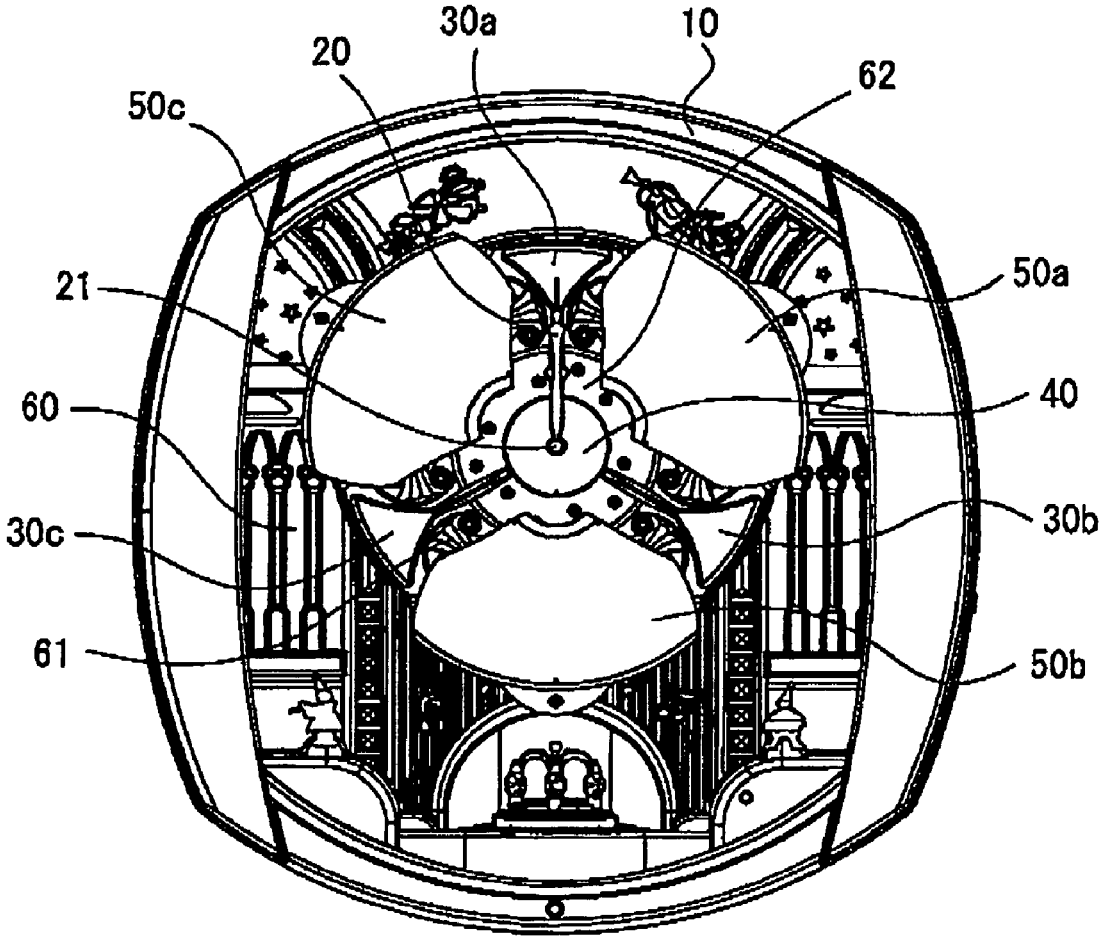
FIG. 2 is a front view showing ornamental members, which are partially exposed when movable segments are opened.
Figure 3:
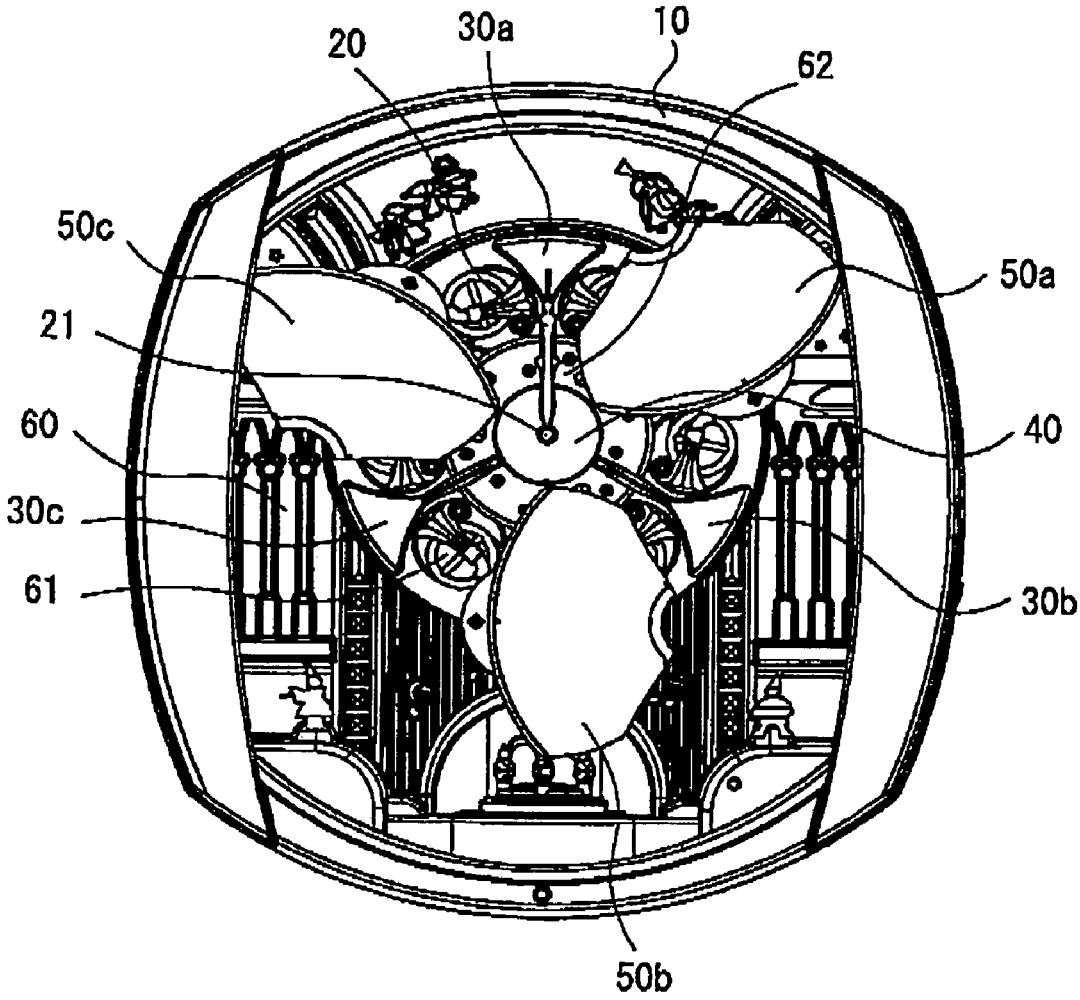
FIG. 3 is a front view of the movable segments that are opened and are further rotated on their axes by 90 degrees.
Figure 4:
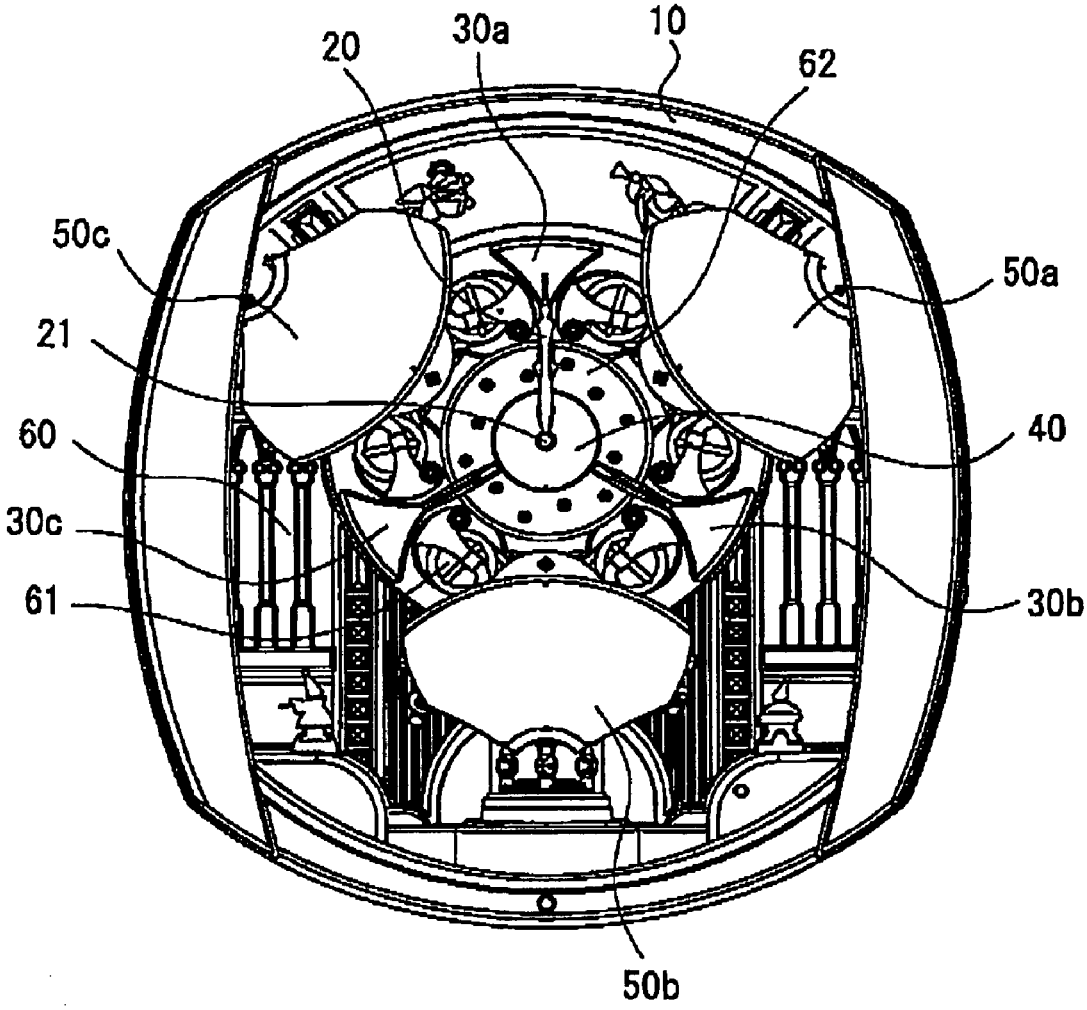
FIG. 4 is a front view of the movable segments that are opened and are further rotated on their axes by 180 degrees.
Figure 5:
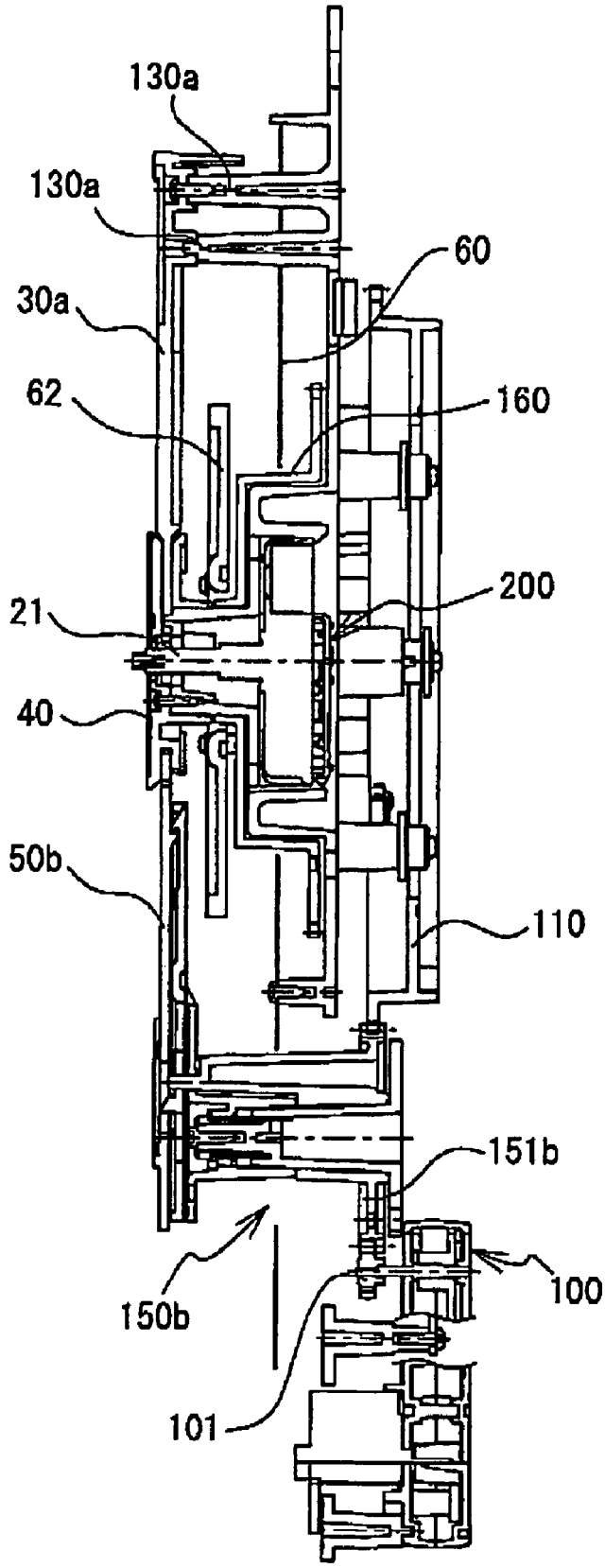
FIG. 5 is a cross-sectional view taken along a line A-A shown in FIG. 1.

FIGS. 1 to 4 show a timepiece according to an embodiment of the present invention. FIG. 1 is a front view of the timepiece. FIG. 2 is a front view of ornamental members, which are partially exposed when movable segments, mentioned later, are opened. FIG. 3 is a front view of movable segments that are opened and are further rotated on their axes by 90 degrees. FIG. 4 is a front view of the movable segments that are opened and are further rotated on their axes 180 degrees. FIG. 5 is a cross-sectional view taken along a line A-A shown in FIG. 1. In FIG. 5, some parts are omitted for the sake of simplicity.

The timepiece of the present embodiment includes a chassis 10, hands 20, first stationary segments 30*a* to 30*c*, a second stationary segment 40, movable segments 50*a* to 50*c*, and a scene plate 60.

The chassis 10 defines a profile of the timepiece in accordance with the embodiment. A glass is attached on the front side of the chassis 10.

The hands 20 include a hour hand and a minute hand for representing a present time. The hands 20 are rotated about a shaft 21. As shown in FIG. 5, the shaft 21 is driven by a movement 200.

An openable and closable dial plate includes the first stationary segments 30*a* to 30*c*, the second stationary segment 40, and the movable segments 50*a* to 50*c*.

The second stationary segment 40 is formed into a circular shape and is fixed at the center of the whole dial plate.

The first stationary segments 30*a* to 30*c* serve as branch portions radially extending from the second stationary segment 40. The first stationary segments 30*a* to 30*c* are fixed and equally spaced by 120 degrees apart. Each of the first stationary segments 30*a* to 30*c* is formed into a thin shape extending from the side near the second stationary segment 40 to a middle portion. Further, each of the first stationary segments 30*a* to 30*c* is formed into a divergent shape extending from the middle portion outwards. The outermost portion of the divergent shape of each of the first stationary segments 30*a* to 30*c* constitutes at least a part of the whole profile of the dial plate.

The movable segments 50*a* to 50*c* are each formed into a fan shape and are supported to move radially around the second stationary segment 40. Furthermore, the movable segments 50*a* to 50*c* each come free from the second stationary segment 40 and rotates at a predetermined position. An ornamental plate 61 and a rotating ornamental plate 62, installed behind the movable segments 50*a* to 50*c*, are exposed by causing the movable segments 50*a* to 50*c* to move apart from the second stationary segment 40. Therefore, the opening or closing action of the movable segments 50*a* to 50*c* permits the ornamental plate 61 and the rotating ornamental plate 62 to be exposed or covered.

The scene plate 60 is decorated and is installed behind the dial plate mentioned above.

The rotating ornamental plate 62 is coaxially arranged with the second stationary segment 40 and is installed behind the second stationary segment 40. The rotating ornamental plate 62 is rotatably provided.

Additionally, FIG. 5 only shows a driving mechanism 150*b* for driving the movable segment 50*b*, but does not show another driving mechanism. The numbers printed on the dial plate are omitted in FIGS. 1 to 4.

A description will now be given of action of the timepiece in accordance with the present embodiment.

As shown in FIG. 1, the movable segments 50*a* to 50*c* are usually positioned at a closed position and the ornamental plate 61 and rotating ornamental plate 62 are not exposed.

When a predetermined time has come, as shown in FIG. 2, the movable segments 50*a* to 50*c* move radially in a plane that is substantially perpendicular to the shaft 21, respectively centering around the second stationary segment 40, with the center of the shaft 21 being an original point, and then come free from the first stationary segments 30*a* to 30*c* and the second stationary segment 40. Specifically, in the above plane, the movable segment 50*a* linearly moves in an upper right-hand direction, the movable segment 50*b* moves in a downward direction, and the movable segment 50*c* moves in an upper left-hand direction. Thus, each of the movable segments 50*a* to 50*c* travels to reach the closed position.

The movable segments 50*a* to 50*c* reach the closed position, thereby partially exposing the ornamental plate 61 and the rotating ornamental plate 62, which are arranged behind the movable segments 50*a* to 50*c*. Specifically, by causing the movable segments 50*a* to 50*c* to open radially, the ornamental plate 61 and the rotating ornamental plate 62 are partially exposed between the first stationary segments 30*a* to 30*c* and the second stationary segment 40, and the movable segments 50*a* to 50*c*. The rotating ornamental plate 62 starts rotating simultaneously with the driving of the movable segments 50*a* to 50*c*.

Then, the opened movable segments 50*a* to 50*c* each start rotating clockwise at the open position. As shown in FIG. 3, each of the movable segments 50*a* to 50*c* rotates clockwise through 90°. Therefore, the exposed state of the ornamental plate 61 and that of the rotating ornamental plate 62 are greatly changed.

Subsequently, as shown in FIG. 4, each of the opened movable segments 50*a* to 50*c* rotates clockwise through 180°. The movable segments 50*a* to 50*c* are held to be directed to different directions one another. Then, the ornamental plate 61 and the rotating ornamental plate 62 are greatly exposed.

As mentioned above, the exposed state of the ornamental plate 61 and that of the rotating ornamental plate 62 are changed in response to the rotation of the movable segments 50*a* to 50*c*.

Also, each of the movable segments 50*a* to 50*c*, when closing, rotates counterclockwise from the state shown in FIG. 4 and shifts to the states shown in FIGS. 3 and 2. The movable segments 50*a* to 50*c* move toward the center of the second stationary segment 40 from the state shown in FIG. 2 and shift to the state shown in FIG. 1. Where the dial plate is closed, the movable segment 50*a* comes into abutment with the second stationary segment 40 and the first stationary segments 30*a* and 30*b*, the movable segment 50*b* comes into abutment with the second stationary segment 40 and the first stationary segments 30*b* and 30*c*, and the movable segment 50*c* comes into abutment with the second stationary segment 40 and the first stationary segments 30*c* and 30*a*, thus positioning the movable segments 50*a* to 50*c* at the closed position.

As mentioned above, the movable segments 50*a* to 50*c* abut the first stationary segments 30*a* to 30*c* and the second stationary segment 40 and are positioned at the closed position. This configuration easily improves the positional accuracy of the movable segments 50*a* to 50*c* positioned at the closed position. Namely, the movable segments 50*a* to 50*c* abutting with the stationary segments to be positioned at the closed position improves the positional accuracy more than abutting with one another to be positioned at the closed position.

Furthermore, the abutment of the movable segments with the stationary segments minimizes the appearance of boundaries between the movable segment and the stationary segments in the closed state. This improves visibility to the dial plate. Moreover, since the first stationary segments 30*a* to 30*c* and the second stationary segment 40 are disposed such that each of the movable segments 50*a* to 50*c* is separated, the movable segments 50*a* to 50*c* do not abut with each other at the closed position.

A description will now be given of a drive mechanism for driving the movable segment. As shown in FIG. 5, a motor block 100 is located at a lower back side of the timepiece. The motor block 100 serves as a driving source of the movable segments 50*a* to 50*c*. A pinion gear 101 is force-fitted onto an output shaft of the motor block 100. The pinion gear 101 meshes with the rotary member 151*b* provided in a driving mechanism 150*b*. Like the driving mechanism 150*b*, there are provided the drive mechanisms, not shown in FIG. 5, for driving the movable segments 50*a* and 50*c*.

The driving mechanism 150*b* causes the movable segment 50*b* to linearly move and to rotate at a predetermined position according to the rotation of the rotary member 151*b*.

The rotary member 151*b* interlocks an idler gear 110 located at a back of the timepiece at the substantial center. The idler gear 110 interlocks other rotating bodies respectively provided in the drive mechanisms for driving the movable segments 50*a* and 50*c*, respectively. Therefore, the driving force from the motor block 100 is transmitted to the idler gear 110 via the driving mechanism 150*b*, and the driving force of the idler gear 110 is then transmitted to the other drive mechanisms. As mentioned above, the movable segments 50*a* to 50*c* are driven by the driving force of the motor block 100.

A gear 160, which is located behind the rotating ornamental plate 62, has a gear portion formed at the outer circumferential portion thereof. There is provided a drive source, not shown in FIG. 5, for driving the rotating ornamental plate 62. The driving force of the drive source is transmitted to the gear 160 via a gear, not shown.

A plurality of fixed pins 130*a* are provided behind the first stationary segment 30*a* and are projected in a direction substantially perpendicular to and toward the dial plate. The fixed pins 130*a* and a rear portion of the first stationary segment 30*a* are fixed with each other. This allows the first stationary segment 30*a* to be fixed. Likewise, the first stationary segments 30*b* and 30*c* are configured in a similar manner.

A description will now be given in detail of the movable segments and the first stationary segment.

Figure 6A:
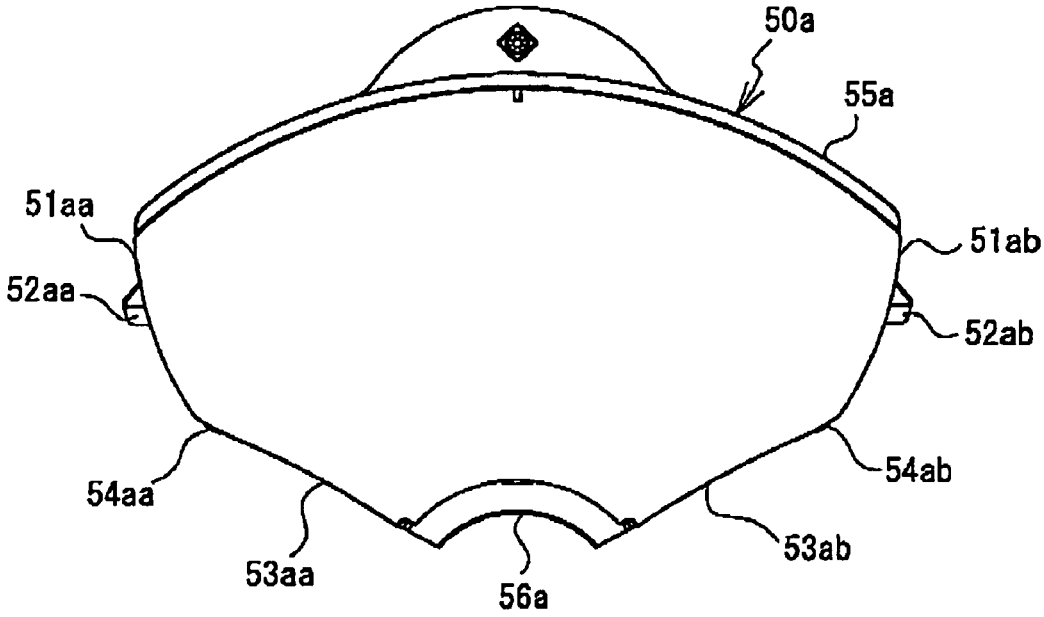
FIGS. 6A and 6B illustrate a movable segment.
Figure 6B:
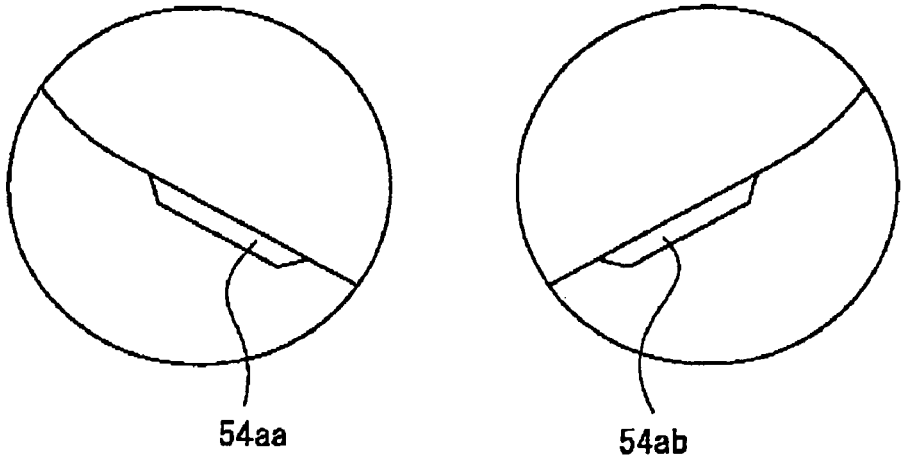

FIGS. 6A and 6B illustrate the movable segment. By way of example, the movable segment 50*a* will now be discussed. FIG. 6A is a front view of the movable segment 50*a*, and FIG. 6B is a partially enlarged view of the movable segment 50*a*.

Figure 7A:
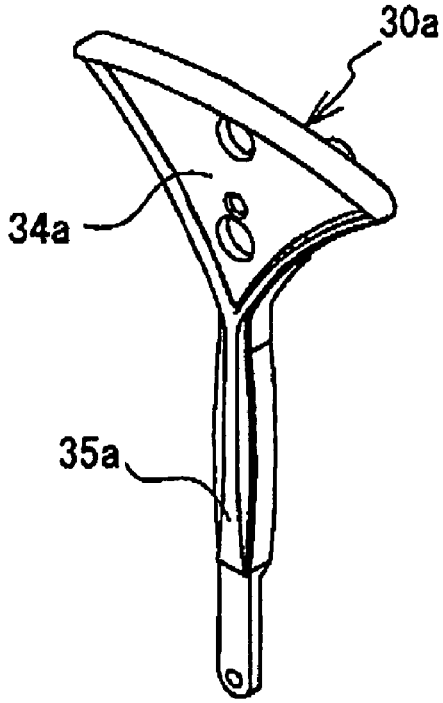
FIGS. 7A and 7B illustrate a first stationary segment.
Figure 7B:
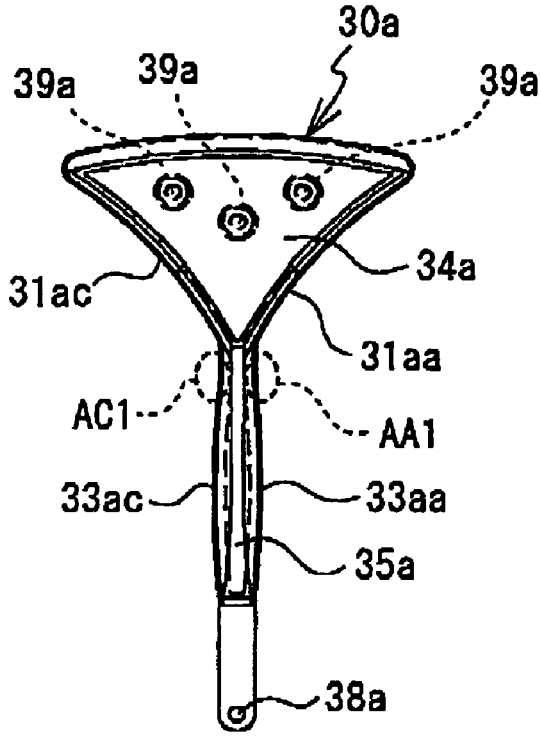

FIGS. 7A and 7B illustrate the second stationary segments. By way of example, the first stationary segment 30*a* will now be discussed. FIG. 7A is a perspective view of the first stationary segment 30*a*, and FIG. 7B is a front view of the first stationary segment 30*a*.

Referring now to FIG. 6, the movable segment 50*a* has: an edge portion 55*a* partially constituting in the whole profile of the dial plate at the closed position; edge portions 51*aa* and 53*aa* facing the first stationary segment 30*a* at the closed position; edge portions 51*ab* and 53*ab* facing the first stationary segment 30*b* at the closed position; and an edge portion 56*a* abutting with the second stationary segment 40 at the closed position. The distance between the edge portion 51*aa* and the edge portion 55*a* is shorter than that between the edge portion 53*aa* and the edge portion 55*a*. The distance between the edge portion 51*ab* and the edge portion 55*a* is shorter than that between the edge portion 53*ab* and the edge portion 55*a*. The edge portions 53*aa* and 53*ab* are steeply continued from the edge portions 51*aa* and 51*ab*, respectively, to the edge portion 56*a*.

The angular difference between the edge portions 53*aa* and 53*ab*, corresponding to that between the first stationary segments 30*a* and 30*b*, is about 120 degrees.

At the closed position, the edge portion 56*a* is inserted into a recess formed at a back side of the second stationary segment 40 and is not exposed.

As shown in FIG. 7, the first stationary segment 30*a* has a divergent portion 34*a* and a narrow portion 35*a*. The divergent portion 34*a* is formed to be located apart from the second stationary segment 40. The narrow portion 35*a* is formed in the proximity of the second stationary segment 40. Three recesses 39*a* are provided at the back face of the divergent portion 34*a*. The recesses 39*a* are provided to be attached to the fixed pins 130*a* shown in FIG. 5. An opening 38*a* for fixation is formed at one end, closer to the second stationary segment 40, of the narrow portion 35*a*.

The first stationary segment 30*a* has edge portions 31*aa* and 31*ac* of the divergent portion 34*a*, and edge portions 33*aa* and 33*ac* of the narrow portion 35*a*. The edge portions 31*aa* and 31*ac* are respectively continuous with the edge portions 33*a* and 33*ac* toward one end of the narrow portion 35*a*.

The edge portion 51*aa* faces the edge portion 31*aa* at the closed position. The edge portion 53*aa* faces the edge portion 33*aa* at the closed position. Likewise, the edge portions 51*ab* and 53*ab* respectively face edge portions of a divergent portion and a narrow portion of the first stationary segment 30*b*.

Engagement pieces 52*aa* and 52*ab* are formed in the edge portions 51*aa* and 51*ab* respectively. The engagement piece 52*aa* is engaged with a recess portion, not shown, formed at a back face of the divergent portion 34*a* at the closed position. Likewise, the engagement piece 52*ab* is engaged with a recess portion, not shown, formed at a back face of the divergent portion of the first stationary segment 30*b*.

As shown in FIG. 6B, abutment pieces 54*aa* and 54*ab* are formed at the edge portions 53*aa* and 53*ab* respectively. The abutment pieces 54*aa* and 54*ab* are each formed into a slightly projecting shape. End faces of the abutment pieces 54*aa* and 54*ab* are formed substantially parallel with end faces of the edge portions 53*aa* and 53*ab* respectively. Therefore, the angular difference between the end faces of the abutment pieces 54*aa* and 54*ab* is approximately 120 degrees.

The movable segment 50*a* travels in such a manner as to be pushed between the first stationary segments 30*a* and 30*b*, and is positioned from the open position to the closed position. On this occasion, the abutment piece 54*aa* comes into abutment with a part of the edge portion 33*aa*, and the movable segment 50*a* is then positioned at the closed position. Specifically, the abutment piece 54*aa* comes into abutment with a part AA1 surrounded by dashed lines shown in FIG. 7B. A part AC1 comes into contact with a contacting piece formed in the movable segment 50*c*.

As mentioned above, the angular difference between the end faces of the abutment pieces 54*aa* and 54*ab* is about 120 degrees. Further, the first stationary segments 30*a* and 30*b* which come into abutment with the abutment pieces 54*aa* and 54*ab* respectively are spaced by about 120 degrees apart. Therefore, the movable segment 50*a* is positioned by the wedge effect of the abutment of the movable segment 50*a* with the first stationary segments 30*a* and 30*b*. These configurations prevent the movable segment 50*a* positioned at the closed position from being misaligned by external shocks. Likewise, the movable segments 50*b* and 50*c* are similarly configured. This maintains the positional accuracy of the movable segments 50*a* to 50*c* at the closed position.

Figure 8:
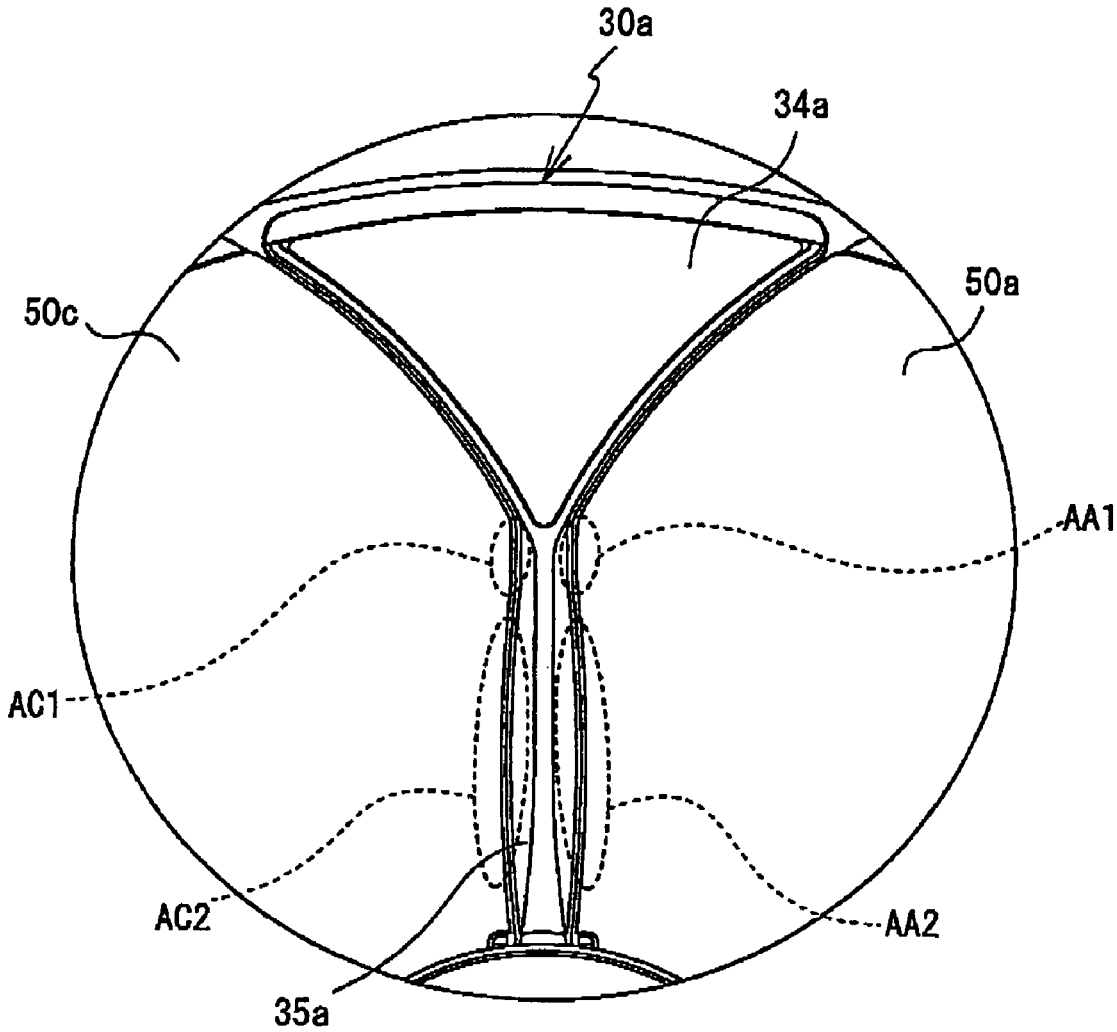
FIG. 8 is an enlarged view showing the first stationary segment and the movable segments positioned at a closed position.

FIG. 8 is an enlarged view showing the first stationary segment 30*a* and the movable segments 50*a* and 50*c* positioned at the closed position. The stationary segment 30*a* abuts with the abutment pieces 54*aa* and 54*ac* at parts AA1 and ACT respectively. The distance between a part AA2 and the second stationary segment 40 is shorter than that between the part AA1 and the second stationary segment 40. However, in the part AA2, the edge portion 33*aa* is spaced apart from the edge portion 53*aa*. Likewise, a part AC2 is configured. The first stationary segments 30*b* and 30*c* are similarly configured.

These arrangements facilitates the movement of the movable segment 50*a* from the closed position to the open position as compared to cases where most of the edge portions 53*aa* and 53 *ab* abut with the first stationary segments 30*a* and 30*b* respectively. That is, as to the movable segment 50*a*, only the abutment pieces 54*aa* and 54*ab* abut with the first stationary segments 30*a* and 30*b* respectively, thereby restraining the excess of the wedge effect mentioned above. This enables the movable segment 50*a* to smoothly shift from the closed position to the open position.

While the preferred embodiments of the present invention have been illustrated in detail, the present invention is not limited to the above-mentioned embodiments, and other embodiments, variations and modifications may be made without departing from the scope of the present invention.

Finally, several aspects of the present invention are summarized as follows.

According to an aspect of the present invention, there is provided a timepiece having an openable and closable dial plate, a stationary segment included in the dial plate, and a movable segment included in the dial plate and reciprocating between an open position and a closed position, the movable segment being positioned at the closed position by abutting with the stationary segment.

In the above configuration, since the movable segment abuts with the stationary segment, the positional accuracy of the movable segment at the closed position can be improved with ease. This improves the visibility to the dial plate.

In the timepiece, the movable segment may include a plurality of the movable segments arranged around the stationary segment and the stationary segment separates the plurality of the movable segments apart from each other at the closed position.

With the above arrangement, since the movable segments do not abut with each other, the positional accuracy of the movable segment can be maintained.

In the timepiece, the movable segment may be maintained at the closed position by a wedge effect due to the movable segment in abutment with the stationary segment.

With such a configuration, the movable segment positioned at the closed position can be prevented from being misaligned by external shocks.

In the timepiece, the stationary segment and the movable segment may have edge portions each facing each other at the closed position, the edge portions formed to partially abut with each other to make the wedge effect on the movable segment and to be partially apart from each other to restrain the wedge effect from becoming excessive.

With the above arrangement, it is possible to prevent wedge effect on the movable segment, enabling the movable segment to smoothly shift from the closed position to the open position.

In the timepiece, the stationary segment may have a plurality of branch portions radially extending from a predetermined position, and the movable segment may be pushed between the adjacent branches and is positioned from the open position to the closed position.

With such a configuration, since the movable segment is sandwiched between the two branch portions, it is easy to make the wedge effect on the movable segment at the closed position.

It is not limited that the whole movable segments be made of three parts, and for example, the whole movable segments may be made of four or more parts.

The present application is based on Japanese Patent Application No. 2007-094300 filed Mar. 30, 2007, the entire disclosure of which is hereby incorporated by reference.

What is claimed is:

1. A timepiece having an openable and closable dial plate, comprising:

a stationary segment included in the dial plate; and a movable segment included in the dial plate and reciprocating between an open position and a closed position, the movable segment being positioned at the closed position by abutting with the stationary segment, wherein the stationary segment has a plurality of branch portions radially extending from a predetermined position, and the movable segment is pushed between the adjacent branches and is positioned from the open position to the closed position.

2. The timepiece according to claim 1, wherein the movable segment comprises a plurality of the movable segments arranged around the stationary segment, and the stationary segment separates the plurality of the movable segments apart from each other at the closed position.

3. The timepiece according to claim 2, wherein the movable segment is maintained at the closed position by a wedge effect due to the movable segment in abutment with the stationary segment.

4. The timepiece according to claim 3, wherein the stationary segment and the movable segment have edge portions each facing each other at the closed position, and the edge portions are formed to partially abut with each other to make the wedge effect on the movable segment and to be partially apart from each other to restrain the wedge effect from becoming excessive.

5. The timepiece according to claim 1, wherein the movable segment is maintained at the closed position by a wedge effect due to the movable segment in abutment with the stationary segment.

6. The timepiece according to claim 5, wherein the stationary segment and the movable segment have edge portions each facing each other at the closed position, and the edge portions are formed to partially abut with each other to make the wedge effect on the movable segment and to be partially apart from each other to restrain the wedge effect from becoming excessive.

* * * * *